United States Patent [19]

Lauterbach

[11] 4,100,315

[45] Jul. 11, 1978

[54] PROCESS FOR LACQUERING METALS

[75] Inventor: Horst Lauterbach, Therwil, Switzerland

[73] Assignee: Ciba-Geigy Corporation, Ardsley, N.Y.

[21] Appl. No.: 783,540

[22] Filed: Apr. 1, 1977

[30] Foreign Application Priority Data

Apr. 13, 1976 [CH] Switzerland ..... 4672/76
Aug. 20, 1976 [CH] Switzerland ..... 10614/76

[51] Int. Cl.[2] ..... B05D 1/38
[52] U.S. Cl. ..... 427/379; 427/386; 427/388 B
[58] Field of Search ..... 27/386, 388 B, 379

[56] References Cited

U.S. PATENT DOCUMENTS 3,787,230 10/1971 Hoffman et al. ..... 427/336

*Primary Examiner*—James R. Hoffman
*Attorney, Agent, or Firm*—Vincent J. Cavalieri

[57] ABSTRACT

The invention provides a process for producing thin-layered adhesive non-porpous films of lacquer on metal surfaces. An aqueous suspension of a solid thermosetting synthetic resin which contains a special alkylphenyloxethylate and/or a special aminococonut fatty acid oxethylate as wetting agent and optionally extenders is used for the purpose. The synthetic resin is in the form of a fine powder with an average granular size from 0.1 to 10 μm. The film is applied by immersion , spraying, coating, rolling or the like, and the curing is preferably effected at elevated temperatures. The use of mixtures of epoxide resins and phenol-formalehyde resins is preferred.

8 Claims, No Drawings

PROCESS FOR LACQUERING METALS

For reasons of industrial hygiene and for ecological reasons, systems containing organic solvents have been replaced in lacquer technology in recent years almost entirely by solvent-free or aqueous systems. In addition to true aqueous lacquer solutions and emulsions, at the present time aqeuous lacquer suspensions are also being used. In this connection, attention is drawn for example to DT-OS No. 2,248,450. These last mentioned lacquer systems have, however, the disadvantage that it is not possible to produce a homogeneous non-porous film of lacquer having a thickness of approx. 10 μm and less on a metal surface. To a large extent this is evidently attributable to the poor wettability and the poor spreading connected therewith. In the end, inhomogeneous, porous films result, which are chemically unstable. A non-porous film which reliably protects the metal can only be produced in such cases by using large amounts of lacquer to obtain film thicknesses of 40 μm and more. However, lacquer films of such thicknesses on metal are only partially of interest; whilst for many uses, especially protective lacquer coatings for tins, film thicknesses of less than 10 μm are required. These problems relating to the wettability, spreading, and finally to the homogeneity and tightness of the films of lacquer, are particularly pronounced in the lacquer coating of tin plate.

The aqueous lacquer systems of DT-OS No. 2,248,450 also have the additional drawback that the solid powder contained therein forms a deposit relatively quickly. They therefore have an inadequate storage life.

It is the object of the present invention to provide a process for providing metals with a lacquer coating using an aqeuous suspension of synthetic resins, which does not have the disadvantages of the use of the known aqeuous suspension systems. The process shall thus give homogeneous non-porous films of lacquer having a thickness of 10 μm and less which effectively protect the coated metal from chemical influences. In particular, it shall be possible to coat tin plate in this manner. In this process, suspensions which have a longer storage life than conventional aqueous synthetic resins will be used.

Accordingly, the invention provides a process for the production of an adhesive, non-porous film on a metal surface by applying an aqueous suspension of a solid thermosetting synthetic resin which contains wetting agents and optionally extenders, or of a synthetic resin mixture, with a granular size in the micron range, by means of a deposition method, such as immersion, spraying, coating, rolling or the like, and subsequent drying and curing, preferably at elevated temperatures, which process comprises the use of a suspension which contains the synthetic resin or synthetic resin mixture particles in an average granular size between 0.1 and 10 μm, preferably between 0.1 and 5 μm, and which contains as wetting agent an alkylphenyloxethylate in which the molecular weight of the oxethylate group is approx. 1700 and the alkyl moiety contains 8 to 12 carbon atoms, and/or an aminococonut fatty acid oxethylate in which an oxethylate group having a molecular weight between approx. 90 and 440 is bonded to the amino group.

According to the invention, the following synthetic resins are used: epoxide resins, phenol-formaldehyde resins, urea-formaldehyde resins and melamine-formaldehyde resins. Both single component systems, in which the synthetic resin already contains the crosslinking or curing constituent in the molecule, and multicomponent systems, which contain a special curer additive, are suitable.

Mixtures of epoxide resins and phenol-formaldehyde resins, in which the latter resin constitutes the hardener for the respective epoxide resin, are particularly suitable for the process of the present invention. An example of such a combination is the very suitable mixture of a bisphenol-A epoxide resin with an epoxide content of 1.1 to 2 mol/kg and a phenol-formaldehyde resin which can be cured at temperatures above 150° C and which has a melting point of 70° C.

In general, the weight ratio of epoxide resin to phenol-formaldehyde resin in such resin mixtures is 4:1 to 1:1 preferably approx. 1.5:1.

If multicomponent systems which contain the base resin and the appropriate hardener and optionally catalysts, or mixtures which contain fillers, colourants, UV absorbers or the like in addition to the resin, are used in the process of the invention, then the procedure to be followed is in general that all the mixture components are homogenised in a melt process in a primary additional process step. After the melt has set, the material is comminuted, preferably using a mill.

In many cases it it more advantageous not to add individual substances, in particular the extenders and wetting agents, until after the melt procedure, i.e. before the grinding procedure or when adjusting the final concentration of the suspension. This latter applies primarily to epoxide resin systems with water-soluble hardeners, for example amines, urea and trimellitic anhydride, or also polymeric substances, such as urea-formaldehyde and melamine-formaldehyde resins. If in such cases the hardener is not added until shortly before the application of the aqueous resin suspension, then the problem of insufficient storage life which may arise is solved in the best possible manner.

According to the invention, it is possible to use in particular polyvinyl acetals, for exampe polyvinyl butyral, as extenders.

It has been established that, in the process of the present invention, in particular those synthetic resins or synthetic resin mixtures which have been brought to the prescribed particle size by a wet grinding, especially using a bead mill, yield outstanding results.

The concentration of the aqueous suspensions which are used according to the invention is 10 to 30% by weight, preferably 15 to 20% by weight.

It is surprising that the two wetting agents, alkylphenyloxethylate and aminococonut fatty acid oxethylate, with the indicated molecular weights of the oxethylate groups, have such an advantageous influence on the formation of the film of lacquer, especially as the many known dispersants and wetting agents of proven worth do not have this action. It is also surprising that the wet grinding process using a bead mill acts so advantageously on the lacquering process of the present invention.

This invention is described in more detail by the following Examples.

EXAMPLE 1

120 g of a solid epoxide resin (bisphenol-A resin, epoxide content 1.3 mol/kg), 80 g of a phenol-formaldehyde resin (melting point 70° C) and 12 g of a polyvinyl butyral (acetal content 76%, polyvinyl alcohol content approx. 20%, acetate 1%, marketed by Hoechst AG under the registered trademark Movital B 30 H), are fused together. After the melt has cooled, it is initially comminuted to a particle size of approx. 1 mm and then, together with 0.6 g of aminococonut fatty acid oxethylate (the oxethylate group having an average molecular weight of approx. 350 is bonded to the amino group) and 500 g of water, is ground for 1 hour in a bead mill (diameter of the glass beads = 4.5 mm). The grinding elements are removed and the resultant suspension, which has a particle size of approx. 1 to 2 μm, is diluted with water to a resin concentration of 15% by weight, referred to the suspension. The surface of a degreased tin plate is coated with the suspension using a spray gun. The coating is thereafter dried for 15 minutes at 20° C and subsequently cured for 10 minutes at 205° C to give a homogeneous, non-porous film of lacquer with an even, smooth surface.

EXAMPLE 2

The procedure of Example 1 is followed, except that the weight ratio of epoxide resin to phenol-formaldehyde resin is 6.5 to 3.5 and that 0.4 g of isooctylphenyloxethylate with an oxethyl residue having a molecular weight of 1700 is used as wetting agent. The granular size of the suspended powder is less than 2 μm. A smooth, non-porous film which effectively protects the tin plate against attack by chemicals is formed.

EXAMPLE 3

The procedure of Example 2 is followed, except that the weight ratio of epoxide resin to phenol-formaldehyde resin is 7.5 to 2.5. A non-porous, smooth film with good resistance to chemicals is also obtained. However, in contrast to the films of Examples 1 and 2, this film is not sufficiently resistant to acetic acid.

EXAMPLES 4 to 7 (Comparison Examples)

Four experiments are carried out which basically also correspond to the procedure of Example 1. However, the conditions are outside the features of the present invention, as is evident from the subsequent table. (For the sake of clarity, Examples 1 to 3 are also included in the table).

EXAMPLE 8

650 g of a solid bisphenol-A epoxide resin (epoxide content 0.6 mol/kg), 350 g of a saturated polyester (acid number approx. 50, m.p. approx. 95° C), 667 g of $TiO_2$ and 15 g of the polyvinyl butyral used in Example 1 are fused together in a Ko-kneader (Buss AG, Switzerland). An aqeuous suspension with a solids content of 40% by weight is prepared in accordance with Example 1 and applied with a spray gun to a degreased steel plate. After predrying and stoving as in Example 1, a homogeneous, glossy film with a perfect surface and good resistance to solvents and chemicals is obtained.

EXAMPLE 9

A mixture of 450 g of triglycidyl isocyanate (particle size approx. 0.5 mm) and 1050 g of water is ground as in Example 1. Then 25 g of urea, 25 g of glycerol and 1.2 g of isooctylphenyloxethylate (as in Example 2) are added. The suspension is sprayed with a lacquer spray gun onto aluminium and steel plates. Predrying and stoving is effected as in Example 1 to yield a white, homogeneous, glossy film with a good surface and good resistance.

EXAMPLE 10

A melt consisting of 200 g of a solid bisphenol-A epoxide resin (epoxide content 0.6 mol/kg) and 12 g of a polyvinyl butyral (as in Example 1) is also processed to a suspension as described in Example 1, but this time with a solids content of 30% by weight. Shortly before the suspension is sprayed onto degreased steel plates, 50 g of a commercial water-soluble urea resin (for example "Beetle 65", marketed by Cyanamid) is stirred into it. Drying and stoving are effected as in Example 1 to yield a homogeneous, glossy film with a good surface and good resistance properties.

Table

| Ex. | Wetting agent | Weight ratio of epoxide resin/phenol-fomaldehyde resin | Fineness of grain μm | Result: film thickness μm | Result: surface | Result: resistance to chemicals and technical usefulness |
|---|---|---|---|---|---|---|
| 1 | aminococonut fatty acid oxethylate; mol.wt.of oxethylate = 350 | 6:4 | 1 to 2 | 5–9 | smooth,non-porous | good |
| 2 | isooctylphenyl-oxethylate; mol.wt.of oxethylate = 1700 | 6.5:3.5 | <2 | 5–9 | smooth,non-porous | good |
| 3 | aminococonut fatty acid oxethylate; mol wt. of oxethylate=350 | 7.5:2.5 | <2 | 5–9 | smooth,non-porous | good, but not resistant to acetic acid |
| 4 | fluorinated alkyl-ester (not of the invention) | 7.5:2.5 | 10–15 | 15–20 | rough, porous | unfit for use |
| 5 | oxethylated nonyl-phenol with 7 oxethyl units (not according to the invention) | 7.5:2.5 | <2 | 5–9 | smooth, porous | unfit for use |
| 6 | fluorinated alkyl ester (not according to the invention) | 7.5:2.5 | <2 | 5–9 | smooth, porous | unfit for use |
| 7 | coconut fatty acid amine (not according to the invention) | 7.5:2.5 | <2 | 5–9 | smooth, porous | unfit for use |

I claim:

1. A process for the production of an adhesive, non-porous film lacquer on a metal surface which comprises applying to a metal surface an aqueous composition suspension comprising a solid thermosetting synthetic resin having an average granular size between 0.1 and 10 μm and a wetting agent selected from the group consisting of an alkylphenyloxethylate in which the oxethylate has a molecular weight of about 1700, and the alkyl moiety contains 8–12 carbon atoms, and an amino coconut fatty acid oxethylate wherein the oxethylate group which has a molecular weight between about 90 and 440 is bonded to the amino group; drying; and curing said composition.

2. The process according to claim 1 wherein said thermosetting synthetic resin is selected from the group consisting of an epoxide resin, phenol-formaldehyde resin, urea-formaldehyde resin and a melamine-formaldehyde resin.

3. The process according to claim 2 wherein said thermosetting synthetic resin comprises a mixture of an epoxide resin and a phenol-formaldehyde resin.

4. The process according to claim 3 wherein said thermosetting synthetic resin is a bisphenol-A epoxide resin with an epoxide content of 1.1 to 2 mol/kg and a phenol-formaldehyde resin which can be cured at a temperature above 150° C and which has a melting point of 70° C.

5. The process according to claim 2 which comprises the addition of a water-soluble hardener to said epoxide resin.

6. A process according to claim 1, wherein the film of lacquer is produced on a tin plate surface.

7. The process according to claim 1 werein said thermosetting synthetic resin has an average particle size in the range of between 0.1 and 5 μm.

8. The process according to claim 1 which comprises the addition of a curing agent to said thermosetting synthetic resin.

* * * * *